US005319950A

United States Patent [19]

Whitt et al.

[11] Patent Number: 5,319,950

[45] Date of Patent: Jun. 14, 1994

[54] ABRASION RESISTANT REINFORCED FABRIC

[75] Inventors: Caleb C. Whitt, Madison; Rudolph W. Howard, Pittsboro; Boyce J. Asbill; Denise C. Yow, both of Asheboro, all of N.C.

[73] Assignee: Kayser-Roth Corporation, Greensboro, N.C.

[21] Appl. No.: 20,553

[22] Filed: Feb. 22, 1993

[51] Int. Cl.[5] ..... D04B 1/14; A41B 11/02; D02G 3/02

[52] U.S. Cl. ..... 66/182; 66/202; 57/210

[58] Field of Search ..... 66/182, 202; 2/239, 2/242; 57/210, 211, 227, 228, 231

[56] References Cited

U.S. PATENT DOCUMENTS

| | | | |
|---|---|---|---|
| 2,138,950 | 12/1938 | Whitehead | 117/21 |
| 2,737,035 | 3/1956 | Bryan et al. | 66/182 |
| 2,769,300 | 11/1956 | Luttge | 57/210 |
| 2,810,949 | 10/1957 | Silver | 28/78 |
| 3,092,955 | 6/1963 | Smit | 57/140 |
| 3,117,410 | 1/1964 | Crouzet | 57/140 |
| 3,301,018 | 1/1967 | Knohl | 66/202 |
| 3,342,044 | 9/1967 | Corey | 66/182 |
| 3,690,056 | 9/1972 | Peters | 57/139 |
| 3,940,917 | 3/1976 | Strachan | 57/152 |
| 4,121,408 | 10/1978 | Maeda | 57/12 |
| 4,150,529 | 4/1979 | Northrup | 57/210 X |
| 4,341,097 | 7/1982 | Cassidy, Sr. et al. | 66/182 X |
| 4,430,851 | 2/1984 | Sundet | 57/210 X |
| 4,467,595 | 8/1984 | Kramers | 57/225 |
| 4,554,121 | 11/1985 | Kramers | 264/103 |
| 4,563,869 | 1/1986 | Stanton | 57/211 |
| 4,733,546 | 3/1988 | Toda | 66/202 |
| 4,918,912 | 4/1990 | Warner | 57/255 |

*Primary Examiner*—Clifford D. Crowder
*Assistant Examiner*—John J. Calvert
*Attorney, Agent, or Firm*—Curtis, Morris and Safford

[57] ABSTRACT

A reinforcing yarn and an abrasion resistant knitted fabric made therewith are disclosed. The reinforcing yarn is made by pairing one end of a "Z"-twist textured yarn together with one end of an "S"-twist textured yarn to yield an S/Z yarn pair. The S/Z yarn pair is then axially twisted in a first direction and stretched before being helically wrapped in the opposite direction with a duplicate S/Z yarn pair to yield a 4-end composite reinforcing yarn. This reinforcing yarn is knit in plaited relationship to the body yarn of a fabric to produce a fabric with exceptional abrasion resistance.

24 Claims, 3 Drawing Sheets

ABRASION RESISTANT REINFORCED FABRIC

BACKGROUND OF THE INVENTION

This invention relates to a reinforcing yarn and fabric having high abrasion resistance made therewith. More particularly, the invention relates to abrasion resistant fabrics made by plaiting a fabric's body yarn with a reinforcing yarn comprised of two ends of textured yarn which are helically wrapped or covered with two substantially similar textured yarn ends. The abrasion resistance enabled with the reinforced yarn of the invention is particularly useful in socks, the knees of pants and the elbows of shirts.

Since the tendency to develop holes during wear is particularly troublesome with socks, the invention will be described with particular reference to socks.

Socks are typically subjected to the greatest wear in the heel and toe regions. Consequently, to improve the wear life of socks, manufacturers have incorporated reinforcement in the heel and toe regions. Toe and heel reinforcements have frequently been used in socks made of cotton, wool and acrylic, or blends thereof. The most common approaches to making abrasion resistant socks have been to incorporate a reinforcing yarn by knitting it in alternating courses with the body yarn of the sock, or, alternatively, plaiting the reinforcing yarn on the primary/body yarn of the sock.

While prior efforts to produce more durable socks using reinforcing yarn as aforedescribed have increased their abrasion resistance, they have not been entirely successful inasmuch as it is still commonplace for socks to wear through in the heel or toe when the remainder of the sock is still in a wearable condition. Efforts to produce socks having improved wear performance have recently focused on the incorporation of para-aramid fibers into sock yarn, to improve abrasion and cut-resistance. An example of such an attempt is described in U.S. Pat. No. 4,918,912. The blended fiber spun yarn described in this patent is said to exhibit a surprising combination of abrasion and cut-resistance. However, para-aramid fiber is considerably more expensive than conventional sock fibers, so any superior results achieved through the use of para-aramid fiber is presumed to come with a price disadvantage.

SUMMARY OF THE INVENTION

It has now been found that a fabric having extraordinary resistance to abrasion can be made by plaiting a special composite reinforcing yarn on a primary/body yarn and knitting the same into fabric where high abrasion resistance is required. A composite reinforcing yarn which has been found to provide extraordinary resistance to abrasion is made by covering a first pair of textured yarns with a second pair of textured yarns. Both the first and second yarn pairs are comprised of one end of "S" twist textured yarn and a parallel end of "Z" twist textured yarn. The first yarn pair is twisted in a first direction and is then covered, or helically wrapped, in the opposite direction with the second yarn pair. When the resultant four-end reinforcing yarn is knit into a fabric in plaited relationship to the body yarn of the fabric, it provides the fabric with extraordinary abrasion resistance.

The preferred reinforcing yarn for use in the invention is textured nylon. Other types of textured yarns, such as polyester, can also be used to make reinforcing yarn according to the invention, inasmuch as it is the composite helically wrapped structure of the reinforcing yarn which provides the principal contribution to the abrasion resistance achieved.

Fabrics made with the described reinforced plaited yarn have a good "hand" or feel, which is desirable for wearing apparel worn adjacent to the skin.

The single ends of Z-twist textured yarn and S-twist textured yarn used in the invention have a minimum of about one turn per inch and not more than about six turns per inch, preferably they have between two and three turns of texturing twist per inch. The Z-twist yarn end and the S-twist yarn end in each S/Z yarn pair preferably have the same number of turns of twist per inch but in opposite directions. The S and Z-twist yarn ends are paired by running both ends through a single traverse before they are wound onto a supply spool with only a producer's twist of not more than about one turn per inch.

The reinforcing yarn of the invention is made by mechanically twisting a first S/Z yarn pair about its axis to provide it with between about three and ten turns per inch, and preferably about five to seven turns per inch. The twisted yarn pair is then stretched and helically wrapped in a direction opposite to its axial twist with a substantially similar S/Z yarn pair so that the elongated first yarn pair is covered with between about three to about ten turns per inch of the second yarn pair, and preferably by about five to about seven wraps per inch of the covering yarn pair.

In accordance with the present invention, an appropriate denier body yarn is knit to form successive courses beginning at the top and extending throughout the leg, foot and toe regions of a hosiery article. If the hosiery article is to be an athletic sock, it is customary for a relatively high denier body yarn to be employed, whereas in a dress-weight sock, a somewhat finer body yarn is used, and in sheer hosiery, a fine denier body yarn is used. Basically, the fiber used in a hosiery article, or other article made of fabric, is a matter of choice, which is governed by the properties desired. The benefits of the present invention are achieved with body yarns of any composition or size.

The reinforcing yarn according to the invention is knit in plaited relationship with the body yarn of an article in all sections of the article in which enhanced abrasion resistance is required. Of course, it is also possible to incorporate reinforcing yarn throughout the entire article, although this is generally unnecessary. Where maximum abrasion resistance is desired, the reinforcing yarn is knit in plaited relationship with the body yarn in each course of yarn. If somewhat lesser abrasion resistance is required, it can be achieved by knitting the reinforcing yarn according to the invention in plaited relationship to the body yarn in alternating or spaced apart courses of yarn. Since the wear resistance of a fabric is improved when the reinforcing yarn of the invention is incorporated in spaced apart yarn courses, in many cases,. it will be unnecessary to incur even the relatively minor additional expense of incorporating reinforcing yarn in all of the courses of the toe and heel regions of a hosiery article. For example, where less than maximum abrasion resistance is required, the reinforcing yarn of the invention can be knit in plaited relationship with the body yarn in alternating courses, or even in every third, fourth, fifth or sixth course of yarn in the areas where high abrasion resistance is desired.

BRIEF DESCRIPTION OF THE DRAWINGS

The invention, as well as its objects and features, will be better understood by reference to the following detailed description of the preferred embodiments of this invention, in conjunction with the accompanying drawings, which are incorporated in and form a part of this specification. In drawings.

DETAILED DESCRIPTION OF THE INVENTION

Figure 1:
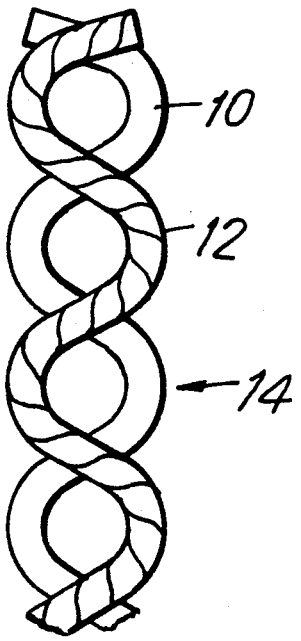
FIG. 1 is an elevational view of an S/Z yarn pair used in the invention.

In accordance with the present invention, one end of Z-twist textured yarn 10 is paired with one end of an S (reverse)-twist textured yarn 12, to produce core yarn pair 14. Yarn ends 10 and 12 are paired by running both yarn ends through a single traverse and winding them onto spool 20. Covering yarn pair 16 is made in the same way by winding one Z-twist yarn end 10 and one S-twist yarn end 12 onto spool 22. Yarn ends 10 and 12 are preferably multi-filament textured yarns, in the size range of about 10 to 200 denier and preferably from about 20 to 100 denier, having at least about one turn of texturing twist per inch and preferably between two and three turns per inch.

Figure 2:
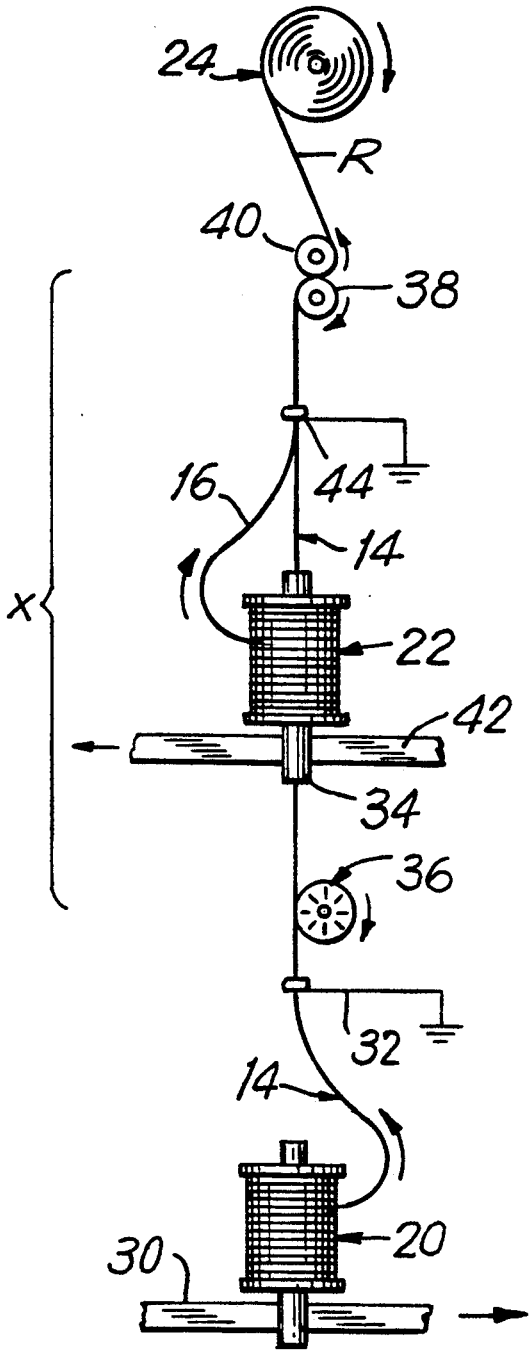
FIG. 2 illustrates schematically an apparatus which can be used in carrying out the present invention.

Core yarn pair 14 is supplied from spool 20 to the covering apparatus depicted in FIG. 2, where it is helically wrapped or covered with substantially identical covering yarn pair 16 in stretch or draft zone X. Yarn pairs 14 and 16 as received from a producer on spools 20 and 22 are substantially untwisted. Twist in the clockwise direction in the range of between about three and ten turns per inch, and preferably between about five and seven turns per inch, is applied to core yarn pair 14 by spinning spool 20 about its own axis with drive belt 30. Core yarn pair 14 twists about its own axis as it is drawn upwardly over the end of spool 20, through guide 32 before advancing axially through the tubular spindle 34 of spool 22.

Wheel 36 and nip rollers 38 and 40 are positively driven at selected speeds by a control means, which is not shown, to control the degree of elongation applied to yarn pair 14. The elongation of yarn pair 14 is maintained by driving nip rollers 38 and 40 so that yarn pair 14 is caused to advance there-between at a higher rate than is permitted by wheel 36. It will be appreciated by those skilled in the art that the degree of elongation in yarn pair 14 might also be regulated by other control schemes. For example, wheel 36 might be eliminated if only a limited amount of elongation is to be imparted to yarn pair 14. Limited elongation can be enabled by air resistance, as yarn pair 14 unwinds from supply spool 20.

The amount of elongation introduced into core yarn pair 14 in stretch zone X is governed by the composition of core yarn pair 14, its denier and level of texturing. Regardless of the control scheme utilized, core yarn pair 14 should be subjected to elongation in the range of about 25% to about 200%, and preferably to elongation in the range of about 50% to about 150%.

Covering yarn pair 16 is applied to core yarn pair s 14 by withdrawing it upwardly over the end of spool 22, which is driven by belt 42 at a selected speed to apply between about three and ten wraps per inch of covering yarn pair 16 on elongated core yarn pair 14. More preferably between five and seven wraps per inch of covering yarn pair 16 are applied to elongated yarn pair 14. When reinforcing yarn R is permitted to relax, core yarn pair 14 has between five and twenty-five wraps per inch, and preferably between eight and eighteen wraps per inch, of covering yarn pair 16 around it.

As covering yarn pair 16 is withdrawn from spool 22, it is not twisted about its own axis, but rather it is wrapped about core yarn pair 14 in a counter-clockwise direction, due to the rotation of driven spool 22. The twist imparted to core yarn pair 14 and the direction of helical wrapping of covering yarn pair 16 thereabout have been described as being respectively in the clockwise and counter-clockwise directions, however opposite orientations can also be used, since it is important only that covering yarn pair 16 be helically wrapped about core yarn pair 14 in a direction opposite to the axial twist imparted to yarn pair 14. The helical winding of yarn pair 16 in a direction opposite to the twist in yarn pair 14 introduces a reverse torque into reinforcing yarn R which tends to cancel the torque introduced into reinforcing yarn R by the twisting of core yarn pair 14. Preferably, a sufficient number of wraps of covering yarn pair 16 is applied to core yarn pair 14 to cancel the torque produced by twisted core yarn pair 14. In this way, a composite reinforcing yarn R which is substantially a non-torque yarn is produced. It has been found that when core yarn pair 14 and covering yarn pair 16 are both composed of substantially identical yarn ends 10 and 12 a reinforcing yarn R having balanced torque is produced when the number of turns per inch of mechanical twisting introduced into core yarn pair 14 is substantially equal to the number of wraps per inch of covering yarn 16 applied to the elongated core yarn pair 14. For example, if core yarn pair 14 and covering yarn pair 16 are both comprised of yarn ends which are 34 filament 100 denier textured nylon with three turns of texturing per inch (in the clockwise direction for yarn ends 10 and in the counterclockwise direction of yarn ends 12), a non-torque reinforcing yarn R will be produced if core yarn pair 14 is mechanically twisted with six turns per inch, stretched to an elongation of 100%, and then covered with six wraps per inch of covering yarn pair 16.

Figure 3:
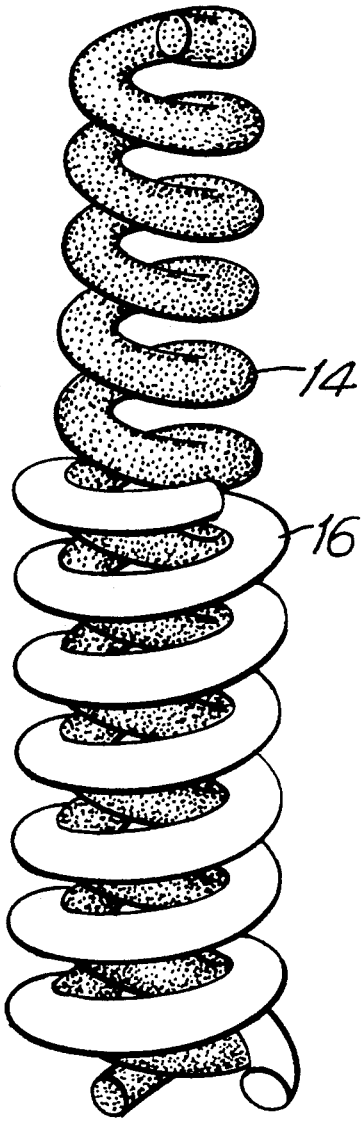
FIG. 3 is a simplified schematic elevational view, partly broken away, of the composite reinforcing yarn of the invention, showing the relationship of the yarn pairs contained therein.

The helically wrapped structure of reinforced yarn R is depicted in simplified schematic view in FIG. 3. In FIG. 3, core yarn pair 14 and covering yarn pair 16 are depicted as unitary composite yarns to facilitate the graphic representation of the structure formed by twisting core yarn pair 14 in one direction and wrapping it in the opposite direction with covering yarn pair 16.

Take-up roll 24 is driven by a control means, not here shown. After reinforcing yarn R emerges from guide 44 and nip rollers 38 and 40, the tension imparted to yarn pair 14 is partially relaxed by controlling the relative speed of rotation of nip rollers 38 and 40 and take-up roll 24. In this way, reinforcing yarn R can be wound on take-up roll 24 with substantially no tension or with any selected tension.

In the described embodiment of the invention, yarns end 10 and 12 in yarn pairs 14 and 16 have the same fiber composition, the same number of filaments per yarn end, substantially the same yard denier and substantially the same number of turns of texturing per inch, so as to produce yarn pairs which have balanced torque, whereby helically wrapping covering yarn pair 16 upon core yarn pair 14, as described, yields a composite yarn which is a substantially balanced non-torque yarn. The aforedescribed yarn characteristics can however be varied, if substantial symmetry is maintained between the respective elements of yarn pairs 14 and 16, or, they can be varied without regard for symmetry, if appropriate tension is maintained on a resulting unbalanced reinforcing yarn, to keep it from kinking or rotating when processed in accordance with the invention. If an unbalanced reinforcing yarn R is ultimately produced, it can be subjected to atmospheric steam to relax the stresses in its component yarns, and provide a torque free reinforcing yarn R.

Figure 4:
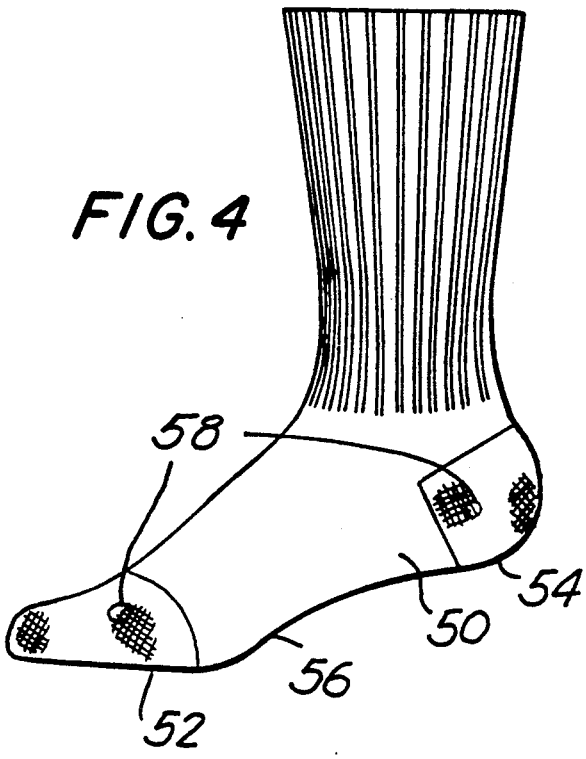
FIG. 4 is an elevational view of one side of a sock, illustrating the incorporation of reinforced toe and heel sections according to the invention.

Sock 50 with reinforced toe section 52 and heel section 54 is illustrated in FIG. 4. As can best be seen in FIG. 5, sock 50 is knit of a body yarn B, forming successive courses (C-1 through C-10) of stitch loops. Although not shown in FIG. 5 in the interest of clarity, in many socks, a stretch or elastic yarn is plaited onto body yarn B in every course thereof. The purpose of such a stretch or elastic yarn is to enhance the sock's stretch and fit. Sock 50 could incorporate such a fit enhancing yarn and reinforcing yarn R is not intended to replace fit-enhancing yarns. For example, if sock 50 were to be a sports sock wherein body yarn B might be a spun yarn of acrylic and/or cotton, it would be typical for the body yarn B to have a fit-enhancing stretch nylon yarn plaited to it throughout the sock. In the described acrylic/cotton sports sock, a typical stretch yarn that might be utilized would be a 34 filament 100 denier stretch nylon. Where necessary for fit in a sock or other garment, body yarn B in FIG. 5 should be understood to represent the composite of a body yarn and an appropriately applied stretch yarn.

Arch section 56 in Sock 20 does not incorporate reinforcing yarn R, because enhanced abrasion resistance is not required in arch section 56.

Figure 5:
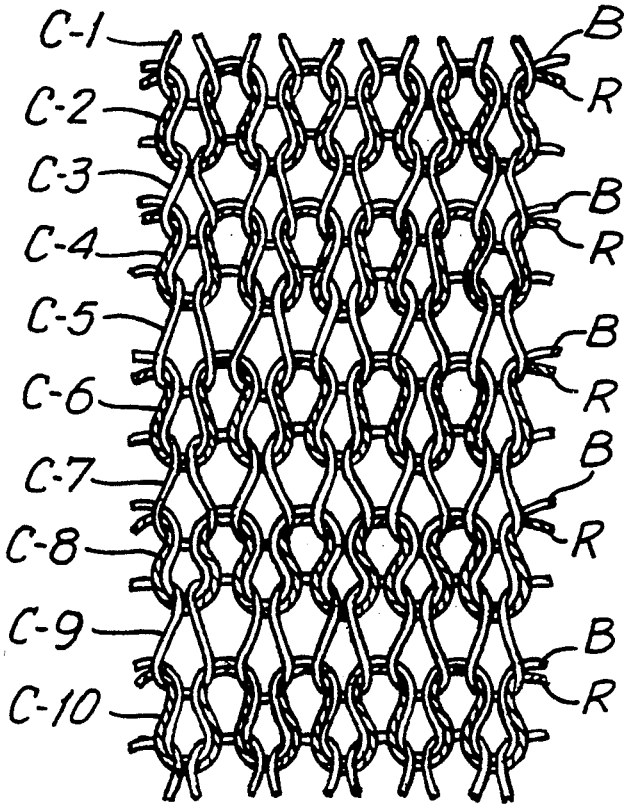
FIG. 5 is a greatly enlarged elevational view of the knitted fabric in the area of circles 58 in FIG. 4, illustrating the manner in which reinforcing yarn is knit in plaited relationship with the body yarn in every other course.
Figure 6:
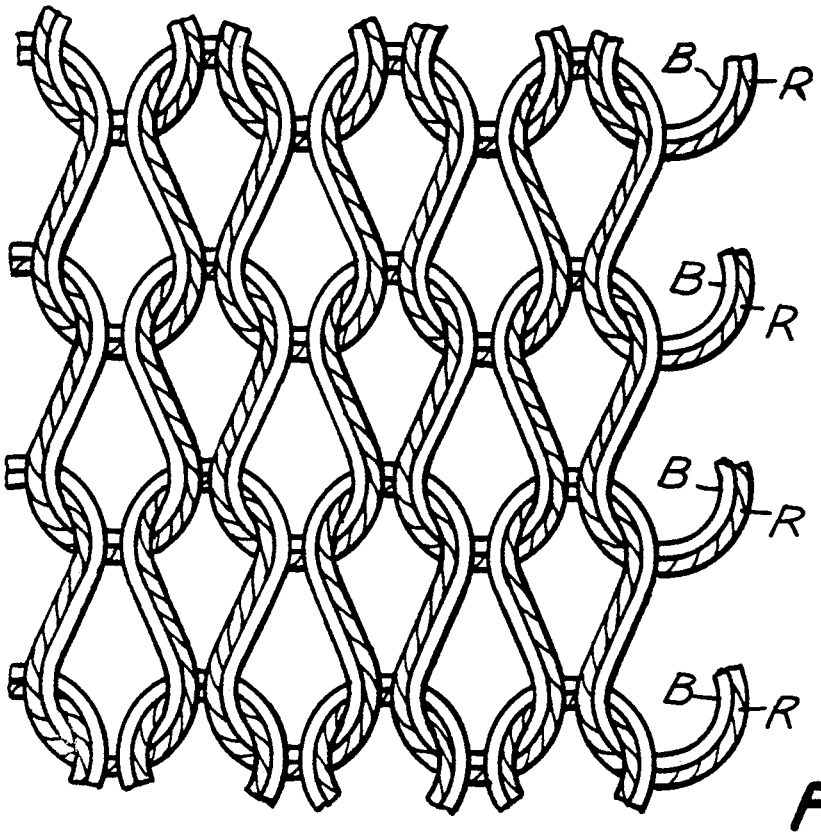
FIG. 6 is a greatly enlarged elevational view of a second embodiment of the knitted fabric according to the invention, wherein the reinforcing yarn is knit in plaited relationship with the body yarn in every course.

As seen in FIG. 5, reinforcing yarn R is knit in plaited relationship with body yarn B in every other course (courses C-2, C-4, C-6, C-8, C-10) of yarn in toe 52 and heel 54 of sock 50. With reinforcing yarn R knit in plaited relationship with the body yarn B in every other course of yarn enhanced, although not maximum, abrasion resistance is imparted thereto. Where maximum abrasion resistance is required, reinforcing yarn R would be knit in plaited relationship with every course of body yarn B, as shown in FIG. 6. Whether reinforcing yarn R is plaited in every course of body yarn B or only in alternation courses, it is plaited with minimal tension so that as applied to body yarn B it is in a substantially relaxed condition.

Figure 7:
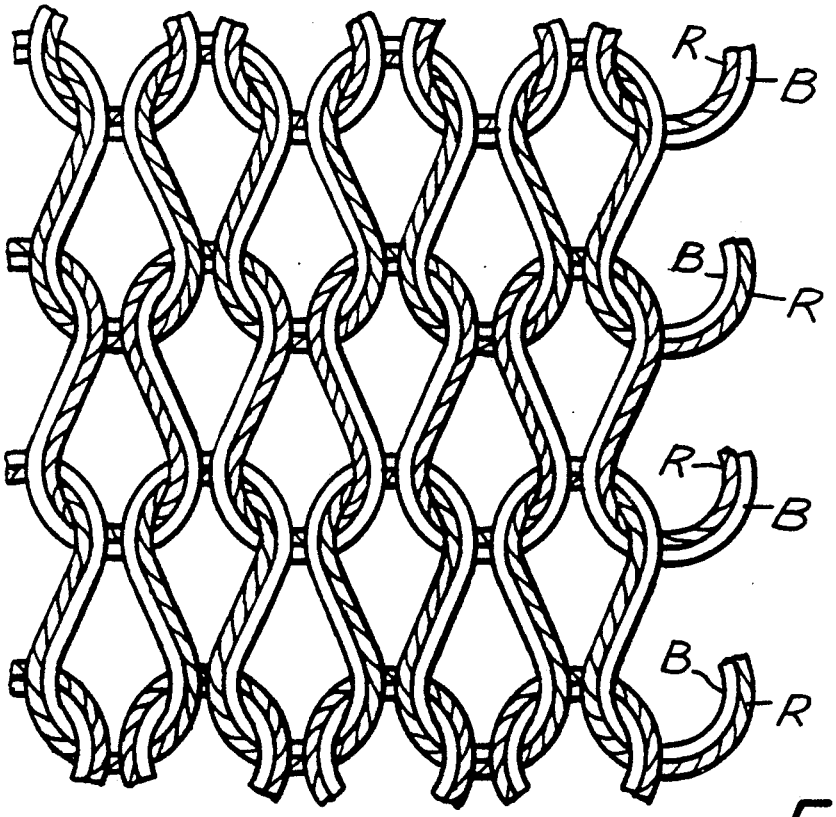
FIG. 7 is a greatly enlarged elevational view of a third embodiment of the knitted fabric according to the invention, wherein the reinforcing yarn is plaited on every course of the body yarn, but alternates its position relative to the body yarn from the inside face of the fabric to the outside face of the fabric.

In another preferred embodiment of the invention, depicted in FIG. 7, reinforcing yarn R is knitted in plaited relationship with body yarn B in every course of toe 52 and heel 54, but alternates its position relative to body yarn B, that is from the inside of the fabric to the outside of the fabric, in every other course. This alternate relative placement of reinforcement yarn R and body yarn B is achieved by changing the order in which yarn is fed into the needles of the circular knitting machine used to make sock 50. Basically, the yarn fed nearest the head of the needle goes to the front of the needle hook when a loop is being formed, and ultimately knocks over to the back side of the knitted fabric. For the courses where it is desired that reinforcement yarn R be positioned on the back side of the fabric, reinforcement yarn R is fed nearest the head of the knitting needle, with body yarn B behind it. In the next succeeding course, where the reverse plaiting is desired, body yarn B is fed nearest the head of the needle and goes to the front of the needle hook, whereupon when the knit loop is being formed, body yarn B knocks over so that it is on the surface of the back side of the fabric.

As a specific but not limiting example, it has been found that a hosiery article having extraordinary wear resistance can be made with reinforcing yarn R which is comprised of textured yarn ends 10 and 12 which are 34 filament 100 denier textured nylon with three turns per inch (in the counterclockwise direction for the S-twist yarns 12 and in the clockwise direction for the Z-twist yarns 10). Core yarn pair 14 and covering yarn pair 16 are both made by passing one Z-twist yarn end 10 and one S-twist yarn end 12 through the same traverse and then winding the paired yarn ends onto supply spools 20 and 22. Core yarn pair 14 is then mechanically twisted in the Z direction with approximately six turns per inch and stretched to an elongation of approximately 100%. Covering yarn pair 16 is then helically wrapped in the S direction on elongated core yarn pair 14 with approximately six turns per inch. When permitted to relax, the resulting reinforcing yarn R has approximately 12 wraps per inch of covering yarn pair 16 around it and is a balanced non-torque yarn. In this example, sock 50 is an acrylic sport sock and reinforcing yarn R is plaited on each course of a 450 denier high bulk acrylic body yarn B in the toe 52 and heel 54 of sock 50 with reinforcing yarn R alternating in every other course from a plaited position on the outside of body yarn B to a position on the inside of body yarn B. Since a high bulk acrylic yarn has insufficient elasticity to provide the desired fit in most sock constructions, a 34 filament 100 denier stretch nylon would ordinarily also be applied to body yarn B throughout every yarn course of sock 50. The reinforced sock so produced has abrasion resistance in excess of any known commercially available acrylic sock, including conventionally reinforced acrylic socks.

Another example of a hosiery article in which the reinforcing yarn of the invention provides extraordinary wear resistance is a dress cotton sock, wherein body yarn B comprises a mercerized cotton yarn of approximately 210 denier. To provide cotton body yarn B with adequate stretch for fit, it incorporates plaited stretch yarn throughout the entire sock consisting of two ends of 17 filament 50 denier denier nylon stretch yarn. These stretch yarns are not separately shown in the drawings wherein body yarn B should be deemed to include the described fit enhancing yarns. In the dress cotton sock of this example, textured yarn ends 10 and 12 are both 17 filament 50 denier nylon with approximately two and a half turns of texturing per inch (in a counterclockwise direction for the S-twist yarns 12 and in a clockwise direction for the Z-twist yarns 10). Core yarn pair 14 and covering yarn pair 16 are both made by passing one Z-twist yarn end 10 and one S-twist yarn end 12 through the same traverse and then winding the paired yarn ends onto supply spools 20 and 22. Core yarn pair 14 is then mechanically twisted in the Z direction with approximately five turns per inch and stretched to an elongation of approximately 120%. Covering yarn pair 16 is then helically wrapped in the S direction on the elongated core yarn pair 14 with approximately five wraps per inch. When permitted to relax, the resulting reinforcing yarn R has approximately eleven wraps per inch of covering yarn pair 16 around it, and is a balanced non-torque yarn. Reinforcing yarn R is plaited on the cotton body yarn B in the toe 52 and heel 54 of sock 50 but is applied only to alternating courses of body yarn B, as depicted in FIG. 5. In this example, reinforcing yarn R is plaited on the outside of body yarn B in each course in which it is incorporated. The reinforced sock 50 so produced has superior wear resistance. It will be appreciated that while, in this example, reinforcing yarn R is incorporated only in every other course of yarn in toe 52 and heel 54 of sock 50, if maximum abrasion resistance were to be desired, reinforcing yarn R would be applied to every course of body yarn B.

Another example of an abrasion resistant sock according to the invention is a dress nylon sock. In such a sock, body yarn B comprises three ends of 34 filament 70 denier nylon. Because of the excellent stretch characteristics of the body yarn in the described nylon sock, unlike the prior examples, a stretch yarn is not incorporated to enhance fit. In this example, textured yarn ends 10 and 12 are both 10 filament 30 denier textured nylon with four turns per inch (in the counterclockwise direction for the S-twist yarns 12 and in a clockwise direction for the Z-twist yarns 10). Core yarn pair 14 and covering yarn pair 16 are both made by passing one Z-twist yarn end 10 and one S-twist yarn end 12 through the same traverse and then winding the paired yarn ends onto supply spools 20 and 22. Core yarn pair 14 is then mechanically twisted in the Z direction with approximately four turns per inch and stretched to an elongation of approximately 150%. Covering yarn pair 16 is then helically wrapped in the S direction on elongated core yarn pair 14 with approximately four wraps per inch. When permitted to relax, the resulting reinforcing yarn R has approximately 10 turns per inch of covering yarn pair 16 around it and is a balanced non-torque yarn. The resulting reinforcing yarn R is plaited on each course of nylon body yarn B in the tow 52 and heel 54 of sock 50. In this example, reinforcing yarn R is plaited on the outside of body yarn B in each yarn course in toe 52 and heel 54.

While the instant invention has been illustrated with specific examples wherein body yarn b was comprised of acrylic, cotton and nylon, and reinforcing yarn R was comprised of nylon yarn ends, extraordinary abrasion resistance would also be provided using the inventing if body yarn B were to consist of any other fiber or combination of fibers and/or reinforcing yarn R were to be comprised of a textured fiber other than nylon, such, for example, polyester or para-aramid fiber.

In the drawings and the specification, there has been set forth in the best mode presently contemplated for the practice of the present invention, and although specific terms are employed, they are used in a generic and descriptive sense only and not for purposes of limitation, it being intended that the scope of the invention be limited solely by the appended claims.

What is claimed is:

1. A reinforced knitted fabric knitted of a body yarn and a reinforcing yarn, said reinforcing yarn comprised of two pairs of yarn ends, the first pair of yarn ends comprising a first end of a textured yarn having between approximately 1 and 6 turns of S-twist per inch and a second end of textured yarn having between approximately 1 and 6 turns of Z-twist per inch, said first pair of yarn ends being mechanically twisted in a first direction with between approximately 3 and 10 turns per inch, the second pair of yarn ends comprising a third end of textured yarn having between approximately 1 and 6 turns of S-twist per inch and a fourth end of textured yarn having between approximately 1 and 6 turns of Z-twist per inch, said second pair of yarn ends being helically wrapped around said first pair of yarn ends in a second direction which is opposite to the direction in which said first pair of yarn ends was mechanically twisted and covering said first pair of yarn ends with about 5 to about 25 wraps per inch of said second pair of yarn ends when said reinforcing yarn is in an unstretched condition and said body yarn and said reinforcing yarn knit in successive courses in plaited relationship in at least every sixth course.

2. A reinforced knitted fabric according to claim 1, wherein each of said first, second, third and fourth ends of textured yarn in said reinforcing yarn are comprised of plied yarns in 10 to 200 denier size range, and said plied yarns are comprised of fibers selected from the group of nylon, polyester and para-aramid.

3. A reinforced knitted fabric according to claim 1, wherein each of said first, second, third and fourth ends of textured yarn in said reinforcing yarn are comprised of plied yarns of nylon in the 20 and 100 denier size range.

4. A reinforced knitted fabric according to claim 1, wherein each of said first, second, third and fourth ends of textured yarn in said reinforcing yarn are comprised of plied yarns in about the 20 to 100 denier size range, and wherein each of said first, second, third and fourth ends of textured yarn have between approximately 1 and 4 twists per inch, and said first pair of yarn ends is mechanically twisted with between approximately 4 and 7 turns per inch.

5. A reinforced knitted fabric according to claim 4, wherein said first, second, third and fourth ends of textured yarn in said reinforcing yarn are comprised of plied stretch nylon, and wherein said second pair of yarn ends is helically wrapped around said first pair of yarn ends to provide about 8 to about 18 wraps per inch covering said first pair of yarn ends when said reinforcing yarn is in an unstretched condition.

6. The reinforced knitted fabric according to claim 4, wherein said second pair of yarn ends in said reinforcing yarn is helically wrapped around said first pair of yarn ends with a number of wraps per inch providing a torque which balances the torque imparted to said reinforcing yarn by the twist in said first pair of yarn ends, whereby the torques introduced by said first and second pairs of yarn ends are substantially balanced and aid reinforcing yarn is a non-torque yarn.

7. The reinforced knitted fabric according to claim 5, wherein said second pair of yarn ends in said reinforcing yarn is helically wrapped around said first pair of yarn ends with a number of wraps per inch providing a torque which balances the torque imparted to said reinforcing yarn by the twist in said first pair of yarn ends, whereby the torques introduced by said first and second pairs of yarn ends are substantially balanced and said reinforcing yarn is a non-torque yarn.

8. The reinforced knitted fabric according to claim 2, wherein said reinforcing yarn is plaited on the body yarn in every course thereof.

9. The reinforced knitted fabric according to claim 5, wherein said reinforcing yarn is plaited on the body yarn in every course thereof.

10. The reinforced knitted fabric according to claim 6, wherein said reinforcing yarn is plaited on the body yarn in every course thereof.

11. The reinforced knitted fabric according to claim 8, wherein said reinforcing yarn is plaited on opposite sides of said body yarn in consecutive courses, whereby said reinforcing yarn is substantially the outside yarn on the front side of the fabric in one course and is substantially the outside yarn on the back side of the fabric in the next succeeding course.

12. The reinforced knitted fabric according to claim 9, wherein said reinforcing yarn is plaited on opposite sides of said body yarn in consecutive courses, whereby said reinforcing yarn is substantially the outside yarn on the front side of the fabric in one course and is substantially the outside yarn on the back side of the fabric in the next succeeding course.

13. The reinforced knitted fabric according to claim 10, wherein said reinforcing yarn is plaited on opposite sides of said body yarn in consecutive courses, whereby said reinforcing yarn is substantially the outside yarn on the front side of the fabric in one course and is substantially the outside yarn on the back side of the fabric in the next succeeding course.

14. The reinforced knitted fabric according to claim 2, wherein said reinforcing yarn is plaited on the body yarn in alternating courses thereof.

15. The reinforced knitted fabric according to claim 5, wherein said reinforcing yarn is plaited on the body yarn in alternating courses thereof.

16. The reinforced knitted fabric according to claim 6, wherein said reinforcing yarn is plaited on the body yarn in alternating courses thereof.

17. An article of clothing comprised of knitted fabric, wherein at least a portion of said fabric is the reinforced knitted fabric of claim 2.

18. An article of clothing comprised of knitted fabric, wherein at least a portion of said fabric is the reinforced knitted fabric of claim 5.

19. An article of clothing comprised of knitted fabric, wherein at least a portion of said fabric is the reinforced knitted fabric of claim 6.

20. An article of clothing comprised of knitted fabric, wherein at least a portion of said fabric is the reinforced knitted fabric of claim 12.

21. A sock comprised of knitted fabric, wherein at least a portion of said knitted fabric is the reinforced knitted fabric according to claim 2.

22. A sock comprised of knitted fabric, wherein at least a portion of said knitted fabric is the reinforced knitted fabric of claim 9.

23. A sock comprised of toe and heel sections made of knitted fabric, wherein the knitted fabric is the reinforced knitted fabric of claim 11.

24. A sock comprised of toe and heel sections made of knitted fabric, wherein the knitted fabric is the reinforced knitted fabric of claim 15.

* * * * *